US006841198B2

(12) United States Patent
Gardner et al.

(10) Patent No.: US 6,841,198 B2
(45) Date of Patent: Jan. 11, 2005

(54) DURABLE PRESS TREATMENT OF FABRIC

(75) Inventors: Robb Richard Gardner, Cincinnati, OH (US); William Michael Scheper, Lawrenceburg, IN (US); Mark Robert Sivik, Mason, OH (US)

(73) Assignee: Strike Investments, LLC, Loveland, OH (US)

( * ) Notice: Subject to any disclaimer, the term of this patent is extended or adjusted under 35 U.S.C. 154(b) by 128 days.

(21) Appl. No.: 10/267,267

(22) Filed: Oct. 9, 2002

(65) Prior Publication Data

US 2003/0111633 A1 Jun. 19, 2003

Related U.S. Application Data

(60) Provisional application No. 60/330,350, filed on Oct. 18, 2001, and provisional application No. 60/341,666, filed on Dec. 18, 2001.

(51) Int. Cl.[7] ..... B05D 3/02

(52) U.S. Cl. ..... 427/392; 427/393.2

(58) Field of Search ..... 427/389.9, 392, 427/393.2

(56) References Cited

U.S. PATENT DOCUMENTS

| | | | | |
|---|---|---|---|---|
| 2,243,765 | A | | 5/1941 | Morton |
| 2,243,786 | A | | 5/1941 | Udy |
| 2,541,457 | A | | 2/1951 | Beer |
| 3,215,488 | A | | 11/1965 | Sulter |
| 3,445,227 | A | | 5/1969 | Weinberger |
| 3,472,606 | A | | 10/1969 | Getchell et al. |
| 3,596,333 | A | | 8/1971 | Kyoto-shi et al. |
| 3,611,131 | A | | 10/1971 | Burkhart et al. |
| 3,660,013 | A | | 5/1972 | Payet et al. |
| 3,663,974 | A | | 5/1972 | Watanabe et al. |
| 3,841,832 | A | | 10/1974 | Swidler et al. |
| 3,886,204 | A | | 5/1975 | Geffers et al. |
| 3,960,482 | A | | 6/1976 | Payet |
| 4,032,294 | A | | 6/1977 | Thompson et al. |
| 4,046,707 | A | | 9/1977 | Smith et al. |
| 4,067,688 | A | | 1/1978 | Payet |
| 4,088,678 | A | | 5/1978 | Matt et al. |
| 4,104,022 | A | | 8/1978 | Payet |
| 4,108,598 | A | | 8/1978 | Payet |
| 4,331,797 | A | | 5/1982 | Martin |
| 4,336,024 | A | | 6/1982 | Denissenko et al. |
| 4,351,796 | A | | 9/1982 | Marshall |
| 4,390,597 | A | * | 6/1983 | Chauvel ..... 428/512 |
| 4,396,390 | A | | 8/1983 | Hendrix et al. |
| 4,520,176 | A | | 5/1985 | Martin et al. |
| 4,530,874 | A | | 7/1985 | Hendrix et al. |
| 4,629,470 | A | | 12/1986 | Harper, Jr. |
| 4,743,266 | A | | 5/1988 | Harper, Jr. |
| 4,780,102 | A | | 10/1988 | Harper, Jr. |
| 4,792,619 | A | | 12/1988 | Berendt et al. |
| 4,820,307 | A | | 4/1989 | Welch et al. |
| 4,936,865 | A | | 6/1990 | Welch et al. |
| 4,975,209 | A | | 12/1990 | Welch et al. |
| 5,006,125 | A | | 4/1991 | Patton et al. |
| 5,018,577 | A | | 5/1991 | Pardue et al. |
| 5,122,158 | A | | 6/1992 | Kuroda et al. |
| 5,135,677 | A | | 8/1992 | Yamaguchi et al. |
| 5,205,836 | A | | 4/1993 | Hansen et al. |
| 5,221,285 | A | | 6/1993 | Andrews et al. |
| 5,242,463 | A | | 9/1993 | Blanchard et al. |
| 5,273,549 | A | | 12/1993 | Didier et al. |
| 5,298,634 | A | | 3/1994 | Connor et al. |
| 5,300,240 | A | | 4/1994 | Wilhelm et al. |
| 5,352,242 | A | | 10/1994 | Lammermann et al. |

(List continued on next page.)

FOREIGN PATENT DOCUMENTS

| | | | |
|---|---|---|---|
| CN | 1313424 | * | 9/2001 |
| EP | 0354648 A3 | | 2/1990 |
| EP | 0354648 A2 | | 2/1990 |
| EP | 0354648 B1 | | 6/1994 |
| EP | 0360747 B1 | | 10/1995 |
| EP | 0491391 B1 | | 5/1996 |
| EP | 0564346 B1 | | 1/1997 |
| EP | 0569731 B1 | | 12/1998 |
| EP | 0976867 A1 | | 2/2000 |
| WO | WO 96/26314 A1 | | 8/1996 |
| WO | WO 98/04772 | | 2/1998 |
| WO | WO 98/31867 | | 7/1998 |
| WO | WO 99/49124 | | 9/1999 |
| WO | WO 99/49125 | | 9/1999 |
| WO | WO 01/21677 A1 | | 3/2001 |
| WO | WO 01/23663 A1 | | 4/2001 |
| WO | WO 01/51496 A1 | | 7/2001 |

OTHER PUBLICATIONS

Yang et al., "Nonformaldehyde Durable Press Finishing of Cotton Fabrics by Combining Citric Acid with Polymers of Maleic Acid", *Textile Research Journal*, Jun. 1998, vol. 68, No. 6, U.S.A.

Zeigler et al., Silicone Based Polymer Science: A Comprehensive Source, Advances in Chemistry Series #224, 1990, pp. 754–755, American Chemical Society, Washington, D. C.

B. Vonicina, Durable Press Finishing of Cotton with Polycarboxylic Acid, Fibres & Textiles in Eastern Europe, Jan.–Mar. 1996, pp. 69–71, Europe.

(List continued on next page.)

*Primary Examiner*—Erma Cameron
(74) *Attorney, Agent, or Firm*—Donald E. Hasse; Hasse & Nesbitt LLC

(57) ABSTRACT

A post mill or post manufacturing process for reducing wrinkle and crease problems in fabric articles is provided. The process involves the domestic or commercial laundry application of a phosphonate- and phosphinate-containing polycarboxylate cross-linking agent followed by at least partial curing of the cross-linking agent via the application of heat to the article. The present invention also includes an article of manufacture or product comprising the treatment composition, at least one container for the treatment composition and accompanying text instructing the user of the product on application of the treatment.

10 Claims, No Drawings

U.S. PATENT DOCUMENTS

| | | | |
|---|---|---|---|
| 5,385,680 | A | 1/1995 | Didier et al. |
| 5,386,038 | A | 1/1995 | Davis et al. |
| 5,496,476 | A | 3/1996 | Tang et al. |
| 5,496,477 | A | 3/1996 | Tang et al. |
| 5,606,105 | A | 2/1997 | Davis et al. |
| 5,695,528 | A | 12/1997 | Komori et al. |
| 5,705,475 | A | 1/1998 | Tang et al. |
| 5,728,771 | A | 3/1998 | Tang et al. |
| 5,755,828 | A | 5/1998 | Westland |
| 5,794,207 | A | 8/1998 | Walker et al. |
| 5,849,039 | A | 12/1998 | Sadlowski |
| 5,866,664 | A | 2/1999 | McCallum, III et al. |
| 5,882,357 | A | 3/1999 | Sun et al. |
| 5,885,303 | A | 3/1999 | Payet |
| 5,891,972 | A | 4/1999 | Egraz et al. |
| 5,965,517 | A | 10/1999 | Mooney |
| 5,998,511 | A | 12/1999 | Westland et al. |
| 6,020,297 | A | 2/2000 | Austin et al. |
| 6,063,884 | A | 5/2000 | Egraz et al. |
| 6,071,434 | A | 6/2000 | Davis et al. |
| 6,136,916 | A | 10/2000 | Arkens et al. |
| 6,165,919 | A | 12/2000 | Yang |
| 6,184,271 | B1 | 2/2001 | Westland et al. |
| 6,184,321 | B1 | 2/2001 | Egraz et al. |
| 6,277,152 | B1 | 8/2001 | Kyriazis et al. |
| 6,300,257 | B1 | 10/2001 | Kirchberger et al. |
| 6,309,565 | B1 | 10/2001 | Stowell et al. |
| 2001/0018542 | A1 | 8/2001 | Gerle et al. |

OTHER PUBLICATIONS

Trask–Morrell et al., Evaluation of Polycarboxylic Acids as Durable Press Reactants Using Thermal and Mass Spectrometric Analyses Under Simulated Cure Conditions, Journal of Applied Polymer Science, 1999, pp. 230–234, New Orleans, LA, John Wiley & Sons, Inc.

Andrews et al., Finishing Additives in Treatment of Cotton Fabrics for Durable Press with Polycarboxylic Acids, Ind. Eng. Chem. Res., 1992, pp. 1981–1984, vol. 31, American Ch mical Society.

C. M. Welch, Formaldehyde–Free DP Finishing with Polycarboxylic Acid, American Dyestuff Reporter, Sep. 1994, pp. 19–26 & 132.

Lewis et al., Durable Press Finishing Of Cotton With Polycarboxylic Acids. I. Preparation of Thiosuccinyl–s–triazine, Journal of Applied Polymer Science, 1997, pp. 1465–1474, vol. 66, John Wiley & Sons, Inc.

Lewis et al., Durable Press Finishing of Cotton with Polycarboxylic Acids. II. Ester Crosslinking of Cotton with Dithiosuccinic Acid Derivative of S–Triazine, Journal of Applied Polymer Science, 1997, pp. 171–177, vol. 66, John Wiley & Sons, Inc.

Yang et al., Infared Spectroscopic Studies of the Nonformaldehyde Durable Press Finishing of Cotton Fabrics by Use of Polycarboxylic Acids, 1991, Journal of Applied Polymer Science, pp. 1609–1616, vol. 43, John Wiley & Sons, Inc.

Blanchard et al., Finishing with Modified Polycarboxylic Acid Systems For Dyeable Durable Press Cottons, 1991, vol. 23, pp. 25–28.

Welch et al, Curing Agents Having Low or Zero Phosphorus Content for Formaldehyde Free DP Finishing with Polycarboxylic Acids, 1993, vol. 25, pp. 25–29.

Schramm, et al, Kinetic Date for the Crosslinking Reaction of Polycarboxylic Acids with Cellulose, 1997, Institute for Textile Chemistry and Textile Physics, vol. 113, pp. 346–349.

Welch, et al., Mixed Polycarboxylic Acids and Mixed Catalyst in Formaldehyde–Free Durable Press Finishing, 1997, Textile Chemist and Colorist, vol. 29, pp. 22–27.

Trask–Morrell, et al, Thermoanalytical Study of Durable Press Reactant Levels on Cotton Fabrics, 1994, Textile Resource Journal, pp. 729–736.

* cited by examiner

DURABLE PRESS TREATMENT OF FABRIC

CROSS REFERENCE TO RELATED APPLICATIONS

This application claims priority under 35 U.S.C. § 119(e) to U.S. Provisional Application Serial No. 60/330,350, filed Oct. 18, 2001 and to U.S. Provisional Application Serial No. 60/341,666, filed Dec. 18, 2001.

FIELD

The present invention relates to textile finishing compositions and methods for employing the compositions in a post mill environment. In particular, the present invention relates to the use of phosphonate- and phosphinate-based cross-linking agents that are applied and cured in a post-textile mill setting, such as a domestic household or commercial laundering facility.

BACKGROUND

The frequent use and care of textile articles, such as linens, garments, etc. lead to the creation of creases or wrinkles in an otherwise crease free article. In the instance of garments, and in particular, cellulosic-based garments, the wear and care of such garments such as the laundering process impart creases and wrinkles into the garment. Consumers must then remove the wrinkle via a variety of methods not the least of which include ironing, pressing and monitored tumble-drying. Frequent or difficult creasing leads quickly to consumer dissatisfaction and complaint. In addition, many cellulosic-based textiles such as rayon lack dimensional stability in the face of domestic water based washing leading to shrinkage of the textile goods.

Manufacturers and designers of textile articles have long sought the application of effective durable press coatings to cellulosic based textiles in order to confer on textiles the key properties of crease resistance and/or crease recovery, dimensional stability to domestic washing and easy care (minimal ironing). Durable press coatings involve the application of a coating to the surface of the textile via the use of a cross-linking agent that cross-links with the cellulose in the fibers of the textile upon the application of heat and reaction catalysts.

Traditional durable press coatings involve the use of formaldehyde or formaldehyde derivatives as the cross-linking agent. Formaldehyde cross-linking agents have long remained the industry standard due to their effectiveness and inexpensive price tag. However, they do result in several significant drawbacks, not the least of which is discoloration and the degradation of the cellulose fibers due to the acid cleavage of the catalyst and the resultant loss of strength of the garment.

In an attempt to remedy the aforementioned drawbacks, the industry has long sought an effective, yet inexpensive cross-linking agent that is formaldehyde-free. The art is replete with the attempts including U.S. Pat. Nos. 5,273,549; 5,496,476; 5,496,477; 5,705,475; 5,728,771; 5,965,517, and 6,277,152 and WO 01/21677. Unfortunately, none to date has been able to match the performance and cost of the formaldehyde-based materials. Accordingly, the need remains for an effective yet inexpensive textile finishing cross-linking agent that is free from formaldehyde or formaldehyde derivatives.

Treatment of cellulosic fabrics in the mill to provide durable press is known. However, the durable press finishes applied in the mill environment have several drawbacks, not the least of which includes degradation over time of the durable press property and increasing consumer dissatisfaction for failing performance. Unfortunately, present day mill applied technology, urea-formaldehyde resins, are unsuitable for a post mill application environment such as domestic or commercial laundering due to the hazardous nature of the ingredients and application conditions required. While domestic application of durable press has been attempted, See U.S. Pat. No. 5,965,517, such attempts have proven unsuccessful due to performance and/or cost of the technology.

It is therefore a long felt need for a durable press treatment process that can be applied to textile articles in a post mill application environment, such as during commercial laundering or a domestic household process, that is effective, inexpensive and safe for the consumer.

SUMMARY

The present invention is directed to a process of providing wrinkle and crease reduction to textile articles. The process comprises providing a fabric treatment composition which includes a cross-linking agent and a suitable cross-linking catalyst. The cross-linking agent is selected from the group consisting of a) homopolymers of ethylenically-α,β-unsaturated dicarboxylates having the formula

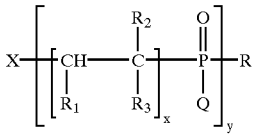

wherein R is independently H, OH, OM, or a unit having the formula

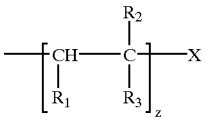

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one, preferably at least two, of $R_1$, $R_2$, or $R_3$ contains a $CO_2M$ moiety; M is H, a salt forming cation; the indices x, y, and z are each independently greater than or equal to 0, preferably from 0 to about 10; x+y+z is greater than or equal to 1, Q is H, OH, OM but not H when both x and z are greater than or equal to 1;

b) Copolymers of ethylenically-α,β-unsaturated dicarboxylates having the formula:

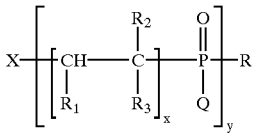

wherein R is independently H, OH, OM, a unit having the formula

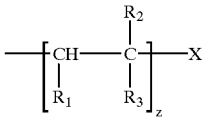

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one, preferably at least two, of $R_1$, $R_2$, or $R_3$ contains a $CO_2M$ moiety; M is H, a salt forming cation; the indices x, y, and z are each independently greater than or equal to 0, preferably from 0 to about 10; x+y+z is greater than or equal to 1, Q is H, OH, OM but not H when both x and z are greater than or equal to 1;

c) copolymers of ethylenically-α,β-unsaturated dicarboxylates polymerized with vinyl-containing monomers where the copolymers have the formula

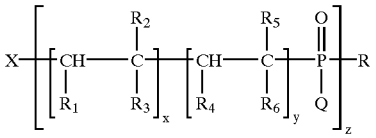

wherein R is independently H, OH, OM, or a unit having the formula:

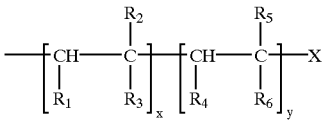

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one, preferably at least two, of $R_1$, $R_2$, or $R_3$ contains a $CO_2M$ moiety; $R_4$, $R_5$, $R_6$ are independently selected from H, alkyl, aryl, alkenyl, carboxy or alkylcarboxy, ester and functionalized esters, anhydride, amide, cyano, urea, alcohol, ether, acetal, phosphino, phosphono, sulfonate, sulfonamide, heterocycles such as imidazole, thiol, thioester, and mixtures thereof; the indices x, y, and z are each independently greater than or equal to 0, preferably from 0 to about 10; x+y+z is greater than or equal to 1, Q is H, OH, OM but not H when both x and z are greater than or equal to 1; and d) mixtures thereof.

The process then concludes with the application of heat to the treated articles to effect at least partial curing of the cross-linking agent. The heat application may be selected from a wide variety of methods including heating, steaming, pressing and/or iron the fabric article.

The present invention is further directed to an article of manufacture for domestic application of durable press benefits to fabric articles. The article comprises a treatment composition having a) at least one cross-linking agent and at least one suitable cross-linking catalyst, b) a container for the treatment composition, and c) accompanying text in association with the container which provides instructions to apply an amount of the treatment composition to a fabric article that corresponds to from about 0.1% to about 20% on weight of fabric of the cross-linking agent and instructions for heating the fabric article to effect at least partial curing of the cross-linking agent.

These and other objects, features, and advantages will become apparent to those of ordinary skill in the art from a reading of the following detailed description and the appended claims.

DETAILED DESCRIPTION

All percentages, ratios and proportions herein are by weight, unless otherwise specified. All temperatures are in degrees Celsius (° C.) unless otherwise specified. All molecular weights are number average molecular weight and are measured using the procedure set forth in "Principles of Polymerization, $2^{ND}$ Ed., Odian, G. Wiley-Interscience, 1981, pp 54–55 using mass spectrometry analysis. All documents cited are in relevant part, incorporated herein by reference.

The present invention meets the aforementioned needs by providing a textile treatment process and article of manufacture that provides superior durable press and shrinkage properties when applied in a post mill process. It has now been surprisingly discovered that the use of cross-linking agents comprising phosphonate- and phosphinate-derivatives of polycarboxylic acids deliver the aforementioned superior results. In addition, it has been surprisingly discovered that durable press can be consistently and effectively delivered to textile articles such as cellulosic garments and cellulose-containing garments, after manufacture, using commercial or domestic fabric treatment processes. The compositions of the present invention may be readily applied by a consumer during a domestic laundry process or as a separate durable press treatment process, as well as in a commercial laundering process. Surprisingly the compositions of the present invention can be readily applied to finished articles without the need for special equipment.

The present invention provides textile treatment compositions having novel cross-linking agents. The textile treatment compositions of the present invention comprise the combination of at least one cross-linking agent with an effective amount of a cross-linking catalyst. The cross-linking agent of the present invention is selected from a class of materials derived from phosphorous containing carboxylic acids and include a) homopolymers of ethylenically-α,β-unsaturated dicarboxylates having the formula:

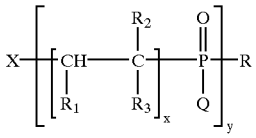

wherein R is independently H, OH, OM, or a unit having the formula

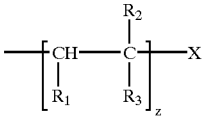

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one, preferably at least two, of $R_1$, $R_2$, or $R_3$ contains a $CO_2M$ moiety; M is H, a salt forming cation; the indices x, y, and z are each independently greater than or equal to 0, preferably from 0 to about 10; x+y+z is greater than or equal to 1, Q is H, OH, OM but not H when both x and z are greater than or equal to 1;

b) Copolymers of ethylenically-α,β-unsaturated dicarboxylates having the formula:

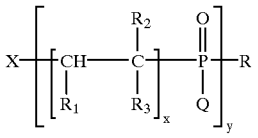

wherein R is independently H, OH, OM, a unit having the formula:

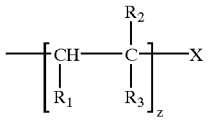

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one, preferably at least two, of $R_1$, $R_2$, or $R_3$ contains a $CO_2M$ moiety; M is H, a salt forming cation; the indices x, y, and z are each independently greater than or equal to 0, preferably from 0 to about 10; x+y+z is greater than or equal to 1, Q is H, OH, OM but not H when both x and z are greater than or equal to 1;

c) copolymers of ethylenically-α,β-unsaturated dicarboxylates polymerized with vinyl-containing monomers where the copolymers have the formula

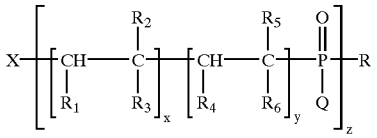

wherein R is independently H, OH, or OM, a unit having the formula:

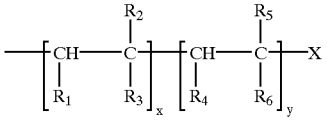

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one, preferably at least two, of $R_1$, $R_2$, or $R_3$ contains a $CO_2M$ moiety; $R_4$, $R_5$, $R_6$ are independently selected from H, alkyl, aryl, alkenyl, carboxy or alkylcarboxy, ester and functionalized esters, anhydride, amide, cyano, urea, alcohol, ether, acetal, phosphino, phosphono, sulfonate, sulfonamide, heterocycles such as imidazole, thiol, thioester;, and mixtures thereof, the indices x, y, and z are each independently greater than or equal to 0, preferably from 0 to about 10; x+y+z is greater than or equal to 1, Q is H, OH, OM but not H when both x and z are greater than or equal to 1.

Of course, one of ordinary skill in the art will recognize that mixtures of the above materials may be employed.

Preferred homopolymers of ethylenically-α,β-unsaturated dicarboxylates in the present invention include maleic and fumaric acid where $R_1$ and $R_2$ are $CO_2X$ and $R_3$ is H; itaconic acid where $R_1$ is H, $R_2$ is $CO_2X$ and $R_3$ is $CH_2CO_2X$; citraconic acid and mesaconic acid where $R_1$ is $CO_2X$, $R_2$ is $CO_2X$ and $R_3$ is $CH_3$; cis- and trans-aconitic acid where $R_1$ is $CO_2X$, $R_2$ is $CO_2X$, and $R_3$ is $CH_2CO_2X$; cis- and trans-glutaconic acid where $R_1$ and $R_2$ are $CO_2X$ or $CH_2CO_2X$ and $R_3$ is H and trans-β-hydromuconic acid where $R_1$ is $CO_2X$, $R_2$ is H and $R_3$ is $CH_2CO_2X$.

Preferred copolymers of all ethylenically-α,β-unsaturated dicarboxylates in the present invention include copolymers of monomers that are selected from maleic, fumaric acid where $R_1$ and $R_2$ are $CO_2X$ and $R_3$ is H; itaconic acid where $R_1$ is H, $R_2$ is $CO_2X$ and $R_3$ is $CH_2CO_2X$; citraconic acid and mesaconic acid where $R_1$ is $CO_2X$, $R_2$ is $CO_2X$ and $R_3$ is $CH_3$; cis- and trans-aconitic acid where $R_1$ is $CO_2X$, $R_2$ is $CO_2X$, and $R_3$ is $CH_2CO_2X$; cis- and trans-glutaconic acid where $R_1$ and $R_2$ are $CO_2X$ or $CH_2CO_2X$ and $R_3$ is H and trans-β-hydromuconic acid where $R_1$ is $CO_2X$, $R_2$ is H and $R_3$ is $CH_2CO_2X$.

Preferably, the cross-linking agents of the present invention is a structural isomers selected from:

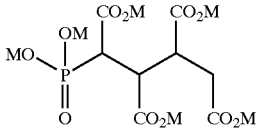

and

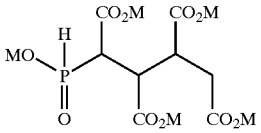

In particular, the present invention has recognized the surprising result that the compositions of the present invention deliver superior properties as described above via the use of cross-linking agents which have a molecular weight in the range of about 110 to about 700 and even more preferably in the range of from about 230 to about 600.

The finishing compositions of the present invention may include in addition to the aforementioned cross-linking agent, a cross-linking or esterification catalyst to facilitate the cross-linking by the cross-linking agents of the present invention with reactive sites on the textile articles that are treated in the process described herein, for example cellulose in the fibers of cellulosic containing textile articles. The esterification catalyst per the present invention may be selected from a wide variety of materials such as phosphorous oxyacids, carbodiimides, hydroxy acids, mineral acids and Lewis acids. Catalyst which may be employed include, by way of example, cyanamide, guanidine or a salt thereof, dicyandiamide, urea, dimethylurea or thiourea, alkali metal salts of hypophosphorus, phosphorus or phosphoric acid, mineral acids, organic acids and salts thereof.

Preferred catalysts include cyanamide, dicyanamide, urea, dimethylurea, sodium hypophosphite, phosphorous acid, sodium phosphate, and mixtures thereof. The fabric is typically treated with an amount of catalyst sufficient to catalyze cross-linking of the natural fibers. In one embodiment, the catalyst may be employed in an amount sufficient to provide a cross-linking agent:catalyst weight ratio in the treatment composition of from about 1000:1 to about 1:2, and preferably from about 10:1 to about 1:1. The treatment compositions herein comprise varying amounts of cross-linking agent depending upon the presence of an optional catalyst. For an embodiment comprising a suitable catalyst capable of catalyzing the reaction of the crosslinking agent and fabric, the composition comprises from about 1% to about 50% by weight, of the cross-linking agent, preferably from about 10% to about 25% by weight and more preferably from about 7% to about 11% or 12% by weight, of the crosslinking agent. Preferably, the catalyst is present at levels of from 0.005% to about 50% by weight to provide a ratio of agent to catalyst is from about 1000:1 to about 1:2.

The treatment composition when employed in process as described herein is designed to deliver from about 0.1% to about 20% of cross-linking agent on weight of the textile article to be treated. More preferably, the treatment composition delivers from about 1% to about 12% of cross-linking agent on weight of the fabric. The treatment composition may optionally include additional ingredients to enhance the characteristics of the final finished textile. Such ingredients are typically selected from wetting agents, brighteners, softening agents, stain repellant agents, color enhancing agents, anti-abrasion additives, water repellency agents, UV absorbing agents and fire retarding agents.

Wetting agents are well known in the field of textile finishing and are typically nonionic surfactants and in particular ethoxylated nonylphenols.

Softening agents are also well known in the art and are typically selected from silicones (including the reactive, amino, and silicone-copolyols as well as PDMS), hydrocarbons (including polyethylenes), fatty acids, quaternary ammonium fatty acid esters/amides, fatty alcohols/ethers, surfactants, and polyethers (including PEG, PPG, PBG). Commercially available materials include Solusoft WA®, Sandoperm MEW®, Ceraperm MW®, Dilasoft RS® all available from Clariant, Freesoft® 25, 100, 425, 970, PE-207, -BNN and 10M, all available from BF Goodrich as well as various other materials.

Stain repellency agents are also well known in the art and are typically selected from fluoropolymers (including acrylates), fluoroalcohols, fluoroethers, fluorosurfactants, anionic polymers (e.g., polyacrylic acid, polyacids/sulfonates, etc), polyethers (such as PEG), hydrophilic polymers (such as polyamides, polyesters, polyvinyl alcohol) and hydrophobic polymers (e.g., silicones, hydrocarbons, and acrylates). Commercially available materials include Zonyl® 7040, 8300 and 8787 from Du Pont Chemcials, Scotchguard® from 3M, Repearl F-35® available from Asahi and Sequapel SF® from OMNOVA Solutions as well as various other materials.

Anti-abrasion additives are also well known in the art and are typically selected from polymers such as polyacrylates, polyurethanes, polyacrylamides, polyamides, polyvinyl alcohol, polyethylene waxes polyethylene emulsions, polyethylene glycol, starches/polysaccharides (both unfunctionalized and functionalized, e.g., esterified) and anhydride-functional silicones. Commercially available materials are selected from Velustrol® available from Clariant and Dicrylan® from Ciba Chemicals as well as various other materials.

Anti-bacterial agents are again well known in the art and are typically selected from quaternary ammonium containing materials such as Bardac/Barquat® from Lonza, quaternary silanes such as DC5700® from Dow Corning, polyhexamethylene biguanide available from Zeneca, halamines from Halosource as well as various other materials.

Hydrophilic finishes for water absorbency are also well known in the art and are typically selected from PEG, surfactants (e.g. anionic, cationic, nonionic, silicone copolyols), anionic polymers (polyacrylic acid, polyvinylalcohol) and reactive anionics Hydrophobic finishes for water repellency are typically selected from silicones (reactive, amino, PDMS, silicone-copolyols, copolymers), hydrocarbons (polyethylenes), fatty acids, quaternary ammonium fatty acid esters/amides, fatty alcohols/ethers and surfactants (with sufficient HLB). UV Protection agents are typically selected from UV absorbers and anti-oxidants.

In addition, the treatment composition of the present invention may include conventional carboxylic acid and/or salts of carboxylic acids cross-linking agents in conjunction with the polymers of the present invention. Such conventional carboxylic acid/salts cross-linkers may be selected from butane tetracarboxylic acid, oxy-disuccinate, iminodisuccinate, thiodisuccinate, tricarbalic acid, citric acid, 1,2,3,4,5,6-cyclohexanehexacarboxylic acid, 1,2,3,4-cyclobutanetetracarboxylic acid and mellitic acid. These conventional cross-linkers may be added at levels of from about 2% to about 20% of the treatment compositions of the present invention.

For the purposes of the process of the present invention, textile articles may be treated in the treatment compositions of the present invention followed by heating of the treated article to effect at least a partial curing of the cross-linking agent. The textile articles are treated herein are fabrics which have completed the manufacturing process and more preferably are consumer owned articles such as linens, garments, draperies, etc. The textile articles preferably comprise natural fibers. Natural fiber refers herein to filaments of cotton as obtained from the cotton boll, short filaments of wool as sheared from the sheep, filaments of cellulose or rayon, or the thin filaments of silk obtained from a silkworm cocoon. "Fabrics" generally refer to knitted fabrics, woven fabrics, or non-woven fabrics prepared from yarns or individual fibers, while "garments" generally refer to wearable articles comprising fabrics, including, but not limited to, shirts, blouses, dresses, pants, sweaters and coats. Non-woven fabrics include fabrics such as felt and are composed of a web or batt of fibers bonded by the application of heat and/or pressure and/or entanglement. "Textiles" includes fabrics, yarns, and articles comprising fabrics and/or yarns, such as garments, home goods, including, but not limited to, bed and table linens, draperies and curtains, and upholsteries, and the like.

As used herein, "natural fibers" refer to fibers which are obtained from natural sources, such as cellulosic fibers and protein fibers, or which are formed by the regeneration of or processing of natural occurring fibers and/or products. Natural fibers are not intended to include fibers formed from petroleum products. Natural fibers include fibers formed from cellulose, such as cotton fiber and regenerated cellulose fiber, commonly referred to as rayon, or acetate fiber derived by reacting cellulose with acetic acid and acetic anhydride in the presence of sulfuric acid. As used herein, "natural fibers" are intended to include natural fibers in any form, including individual filaments, and fibers present in yarns, fabrics and other textiles, while "individual natural fibers" is intended to refer to individual natural filaments.

As used herein, "cellulosic fibers" are intended to refer to fibers comprising cellulose, and include, but are not limited to, cotton, linen, flax, rayon, cellulose acetate, cellulose triacetate, hemp and ramie fibers. As used herein, "rayon fibers" is intended to include, but is not limited to, fibers comprising viscose rayon, high wet modulus rayon, cuprammonium rayon, saponified rayon, modal rayon and lyocell rayon. "Protein fibers" are intended to refer to fibers comprising proteins, and include, but are not limited to, wools, such as sheep wool, alpaca, vicuna, mohair, cashmere, guanaco, camel and llama, as well as furs, suedes, and silks.

As used herein, "synthetic fibers" refer to those fibers that are not prepared from naturally occurring filaments and include, but are not limited to, fibers formed of synthetic materials such as polyesters, polyamides such as nylons, polyacrylics, and polyurethanes such as spandex. Synthetic fibers include fibers formed from petroleum products.

Articles for use in the present invention preferably comprise natural fibers, which natural fibers may be included in any form, including, but not limited to, in the form of individual fibers (for example in nonwoven fabrics), or in the form of yarns comprising natural fibers, woven or knitted to provide the fabrics. Additionally, the articles may be in the form of garments or other textiles comprising natural fibers. The articles may further comprise synthetic fibers. Preferably, the articles comprise at least about 20% natural fibers. In one embodiment, the articles comprise at least about 50% natural fibers such as cotton fibers, rayon fibers or the like.

Application of the treatment composition can be done in any suitable manner, for example, spraying, rolling, padding, soaking, dipping, and the like. One embodiment of the process aspect of the present invention relates to the use of the present process by a service provider. What is meant herein by a service provider is any commercial laundry service or facility including dry cleaners, valet services, laundromats, launderettes and the like. Operations conducted outside the domestic residence may have continuous means for applying the treatment compositions, of unique appliances. For example, the articles may be treated in a system or apparatus having a treatment composition application stage, followed by a drying stage wherein the articles are transported between stages either continuously or in batches. Such process are known and well recognized by one of ordinary skill in the art. Alternatively, the application may include a standard commercial wash process with the application of heat resulting from the pressing, steaming or drying stages of the commercial process.

Alternatively, the application of the treatment composition may comprise the utilization of a domestic home laundering process wherein the treatment composition is applied by the home consumer. The composition may, of course, be applied in the form of a spray, soak, dip or hand wash in a sink, basin or tub. Preferably, the treatment composition is applied via the use of a home appliance such as a washing machine. The composition may be added in the form of a rinse dispersed composition so that application of the cross-linking composition occurs prior to completion of the wash cycle.

The heating step in the domestic utilization of the present invention may include the use of a domestic automatic clothes dryer. Alternatively curing may be accomplished with a clothes iron or home pressing unit. In this last iteration of the home application embodiment, the process may optionally include instructions that direct the user to the proper temperature setting of the iron or automatic clothes dryer.

One iteration of the present invention relates to in an home laundry treatment apparatus that comprises a housing, such as a cabinet. Articles such as garments may be secured within the cabinet into which the fabric treatment composition is distributed such as by spraying, nebulization, atomization or the like followed by the application of heat to effect at least partial curing of the composition. The housing may either be rigid or of a non-rigid flexible material such as a collapsible bag. Non limiting examples of suitable in home fabric treatment apparatus may be found in U.S. Pat. Nos. 5,815,961 and 6,189,346 and in PCT Publication No. WO 00/75413, the disclosures of which are herein incorporated by reference.

The present invention relates to one aspect that encompasses an article of manufacture or product which when used provide a means for the consumer or operator in the case of a post-manufacture laundry service, to render a durable press benefit to fabric. The article comprises a treatment composition having at least one cross-linking agent and at least one suitable cross-linking catalyst; at least one container for the treatment composition; and iii) accompanying text in association with the container which provides instructions to apply an amount of the treatment composition to a fabric article that corresponds to from about 1% to about 20% on weight of fabric of the cross-linking agent and instructions for heating the fabric article to effect at least partial curing of the cross-linking agent.

The treatment composition of the present invention may include separable components (a) and (b) wherein (a) includes the cross-linking agent and (b) includes the cross-linking catalyst both as described herein. The two components may be packaged in separate containers within the product, in a single dual chamber container or may be pre-mixed within a single container in the product.

As described herein above, the product may utilize an article of manufacture which stores component (a) and (b) until the components are to be admixed and used or alternatively the kit may comprise one or more openable pouches, containers, bottles, etc and an optionally included mixing chamber, inter alia, a sealable package, a disposable bowl into which the ingredients of component (a) and (b) are combined. The article of manufacture may relate only to a means for efficiently and effectively delivering the components to a fabric surface and be utilized with a manufacturer's pre-combined durable press providing composition.

The kits of the present invention include an optional accompanying text, inter alia, an insert, package instructions, pamphlet, which instructs the user on the options that are available. For example, depending upon the type of fabric, inter alia, pure cotton, blended fabric, the amount of durable press desired by the consumer may vary widely. In addition, the means available for applying the composition or curing the treated fabric may vary depending upon the type of fabric or the circumstance of use. One embodiment includes instructions which also instruct the user which optional ingredients or adjuncts can be purchased separately or used optionally with the provided ingredients, i.e., component (a) and (b). In addition, the product may include a dispensing element, if necessary, such as a spray device, pre-treat device or alternately a dosing device and/or dispenser. Such a dosing or dispensing element may be part of the container in the form or a dosage cap or gradient markings or various other means or, alternatively may be a separable device such as a scoop, pre-treater or dosage device which is used to dispense liquid and powdered detergents and softeners into domestic laundry processes.

In general, the instructions included in the product herein include instructions to apply an amount of the treatment composition to a fabric article that corresponds to from about 0.1% to about 20% on weight of fabric of the cross-linking agent and instructions for heating the fabric article to effect at least partial curing of the cross-linking agent.

The product of the present invention may included additional treatment composition such as pre-treaters, softeners, etc that may be employed in the process herein.

EXAMPLES

The present invention will now be exemplified via the following non-limiting examples that one of ordinary skill in the art will recognize as merely providing illustration of the presently preferred embodiments of the invention.

Example 1

Itaconic acid (65 g, 0.50 mol) is added to a 500 ml three-necked round-bottom flask fitted with a condenser, internal thermometer, magnetic stirrer, and addition funnel containing 45 ml of water. Sodium hydroxide (40 g, 0.50 mol, 50%) and sodium hypophosphite (24.6 g, 0.28 mol) are added to the reaction flask. The mixture is heated to 85° C. The reagents are treated with potassium persulfate (7.2 g, 0.27 mol) in four portions over 90 minutes. The mixture is heated for an additional 30 minutes. Hydrogen peroxide (41.4 g, 0.37 mol, 30%) is gradually added to the mixture over 3 h. Once addition is complete, the mixture is heated for 1 h at 100° C. The cooled mixture is isolated as a liquid.

Example 2

Maleic acid (29.0 g, 0.25 mol) and itaconic acid (32.5 g, 0.25 mol) is added to a 500 ml three-necked round-bottom flask fitted with a condenser, internal thermometer, magnetic stirrer, and addition funnel containing 45 ml of water. Sodium hydroxide (40 g, 0.50 mol, 50%) and sodium hypophosphite (24.6 g, 0.28 mol) are added to the reaction flask. The mixture is heated to 85° C. The reagents are treated with potassium persulfate (7.2 g, 0.27 mol) in four portions over 90 minutes. The mixture is heated for an additional 30 minutes. Hydrogen peroxide (41.4 g, 0.37 mol, 30%) is gradually added to the mixture over 3 h. Once addition is complete, the mixture is heated for 1 h at 100° C. The cooled mixture is isolated as a liquid.

Example 3

Maleic acid (52.2 g, 0.45 mol) and vinylphosphonic acid (5.4 g, 0.05 mol) is added to a 500 ml three-necked round-bottom flask fitted with a condenser, internal thermometer, magnetic stirrer, and addition funnel containing 45 ml of water. Sodium hydroxide (40 g, 0.50 mol, 50%) and sodium hypophosphite (24.6 g, 0.28 mol) are added to the reaction flask. The mixture is heated to 85° C. The reagents are treated with potassium persulfate (7.2 g, 0.27 mol) in four portions over 90 minutes. The mixture is heated for an additional 30 minutes. Hydrogen peroxide (41.4 g, 0.37 mol, 30%) is gradually added to the mixture over 3 h. Once addition is complete, the mixture is heated for 1 h at 100° C. The cooled mixture is isolated as a liquid.

Example 4

Maleic acid (55 g, 0.50 mol) is added to a 500 ml three-necked round-bottom flask fitted with a condenser, internal thermometer, magnetic stirrer, and addition funnel containing 45 ml of water. Sodium hydroxide (40 g, 0.50 mol, 50%) and sodium hypophosphite (24.6 g, 0.28 mol) are added to the reaction flask. The mixture is heated to 85° C. The reagents are treated with potassium persulfate (7.2 g, 0.27 mol) in four portions over 90 minutes. The mixture is heated for an additional 30 minutes. Hydrogen peroxide (41.4 g, 0.37 mol, 30%) is gradually added to the mixture over 3 h. Once addition is complete, the mixture is heated for 1 h at 100° C. The cooled mixture is isolated as a liquid.

Example 5

In a non-limiting embodiment, a composition including the product of Example 4 in addition to a curing catalyst, is applied in an amount to insure a moisture content of more than 10% by weight, on the fabric before curing. Once the composition has been applied to the fabric, the fabric is cured by ironing at a temperature sufficient for the cross-linking of the natural fibers with the cross-linking agent. For example, the iron temperature may be greater than about 130° C., and held in contact with the fabric for a period of from about 0.5 minutes to about 5 minutes. Without wishing to be limited by theory, there has been found in our hands to be an inverse relationship between curing temperature and curing time, that is, the higher the temperature of curing. For example when using an automatic dryer, the shorter the dwell time in the dryer; conversely, the lower the curing temperature (dryer setting if available), the longer the dwell time in the dryer.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for reducing wrinkle and crease problems in a fabric article, the process comprising the steps of:

a) applying to the article a treatment composition comprising a phosphonate- or phosphinate-containing cross-linking agent and a suitable cross-linking catalyst wherein the cross-linking agent is selected from the group consisting of i) homopolymers of ethylenically-α-β-unsaturated carboxylates having the formula:

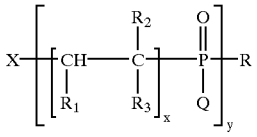

wherein R is independently H, OH, OM, or a unit having the formula:

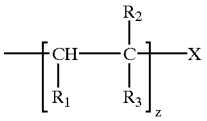

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one of $R_1$, $R_2$, or $R_3$ contains a $CO_2M$ moiety; M is H, or a salt forming cation; the indices x, y, and z are each independently greater than or equal to 0; x+y+z is greater than or equal to 1, Q is H, OH, OM but not H when both x and z are greater than or equal to 1;

ii) copolymers of ethylenically-α-β-unsaturated carboxylates having the formula

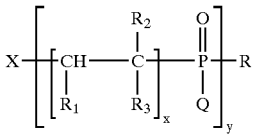

wherein R is independently H, OH, OM, or a unit having the formula

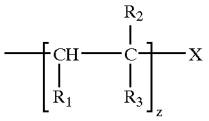

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one of $R_1$, $R_2$, or $R_3$ contains a $CO_2M$ moiety; M is H, or a salt forming cation; the indices x, y, and z are each independently greater than or equal to 0; x+y+z is greater than or equal to 1, Q is H, OH, OM but not H when both x and z are greater than or equal to 1;

iii) copolymers of ethylenically-α-β-unsaturated carboxylates polymerized with vinyl-containing monomers where the copolymers have the formula

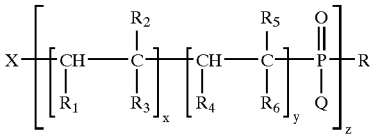

wherein R is independently H, OH, OM, or a unit having the formula

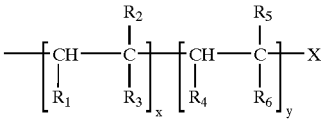

where X is independently selected from H, OH, or $OSO_3M$; $R_1$, $R_2$, $R_3$ are independently selected from H, $CH_3$, $C_1$–$C_{12}$ alkyl, aryl, $CO_2M$, or $(CH_2)_nCO_2M$, where n is from 1 to 12, and at least one of $R_1$, $R_2$, or $R_3$ contains a $CO_2M$ moiety; M is H, or a salt forming cation; $R_4$, $R_5$, $R_6$ are independently selected from H, alkyl, aryl, alkenyl, carboxy or alkylcarboxy, ester and functionalized esters, anhydride, amide, cyano, urea, alcohol, ether, acetal, phosphino, phosphano, sulfonate, sulfonamide, heterocycles such as imidazole, thiol, thioester, and mixtures thereof; the indices x, y, and z are each independently greater than or equal to 0; x+y+z is greater than or equal to 1, Q is H, OH, OM but not H when both x and z are greater than or equal to 1; and iv) mixtures thereof; and b) subjecting the treated article to a heating step to effect cross-linking of the cross-linking agent whereby the heating step comprises the application of heat via post mill application techniques.

2. The process of claim 1 wherein the step of heating is selected from the group consisting of tumble drying, ironing, pressing, steaming and combinations thereof.

3. The process of claim 1 wherein the cross-linking agent is selected from homopolymers of ethylenically-α-β-unsaturated dicarboxylates and at least 50% of the $R^1$ units comprise —$CO_2M$, —$CH_2CO_2M$, and mixtures thereof.

4. The process of claim 3 wherein at least 75% of the $R^1$ units comprise —$CO_2M$, —$CH_2CO_2M$, or mixtures thereof.

5. The process of claim 4 wherein at least 90% of the $R^1$ units comprise —$CO_2M$, —$CH_2CO_2M$, or mixtures thereof.

6. The process of claim 1 wherein the treatment composition comprises from about 1% to about 50% by weight, of the cross-linking agent.

7. The process of claim 6 wherein the treatment composition comprises from about 10% to about 25% by weight, of the cross-linking agent.

8. The process of claim 7 wherein the treatment composition comprises from about 7% to about 12% by weight, of the cross-linking agent.

9. The process of claim 1 wherein the ratio of the cross-linking agent to the catalyst is from about 1:1 to about 5:1.

10. The process of claim 9 wherein the catalyst is sodium hypophosphite.

* * * * *